United States Patent [19]

Vohl

[11] Patent Number: 4,477,988

[45] Date of Patent: Oct. 23, 1984

[54] MODULAR SNOW BLOWER ASSEMBLY

[76] Inventor: Paul-Eugène Vohl, 1738 Principale St., St-Marc des Carrières, Canada, G0A 4B0

[21] Appl. No.: 552,813

[22] Filed: Nov. 17, 1983

Related U.S. Application Data

[63] Continuation-in-part of Ser. No. 391,517, Jun. 24, 1982, abandoned.

[51] Int. Cl.[3] ..... E01H 5/09

[52] U.S. Cl. ..... 37/250

[58] Field of Search ..... 37/250, 244–249, 37/251–259, 231

[56] References Cited

U.S. PATENT DOCUMENTS

| | | | |
|---|---|---|---|
| 2,092,536 | 9/1937 | Sicard | 37/250 |
| 2,152,860 | 4/1939 | Hebrens et al. | 37/250 |
| 2,320,723 | 6/1943 | Gaylord | 37/250 |
| 2,482,213 | 9/1949 | Ritchie | 37/250 |
| 2,733,524 | 2/1956 | Ingbritson | 37/256 |
| 2,882,620 | 4/1959 | MacDonald | 37/250 |
| 3,043,028 | 7/1962 | Merry et al. | 37/250 |
| 3,490,057 | 1/1970 | Kahlbacher | 37/250 |
| 3,562,933 | 2/1971 | Hanneman et al. | 37/250 |
| 3,583,084 | 6/1971 | Farrell | 37/250 |

*Primary Examiner*—E. H. Eickholt

[57] ABSTRACT

A snow blower operatively carried at the end of a carrier vehicle and characterized by its construction to minimize maintenance and downtime at least of the snow blower as a whole. This snow blower is of modular construction, allowing to readily separate a front snow-blowing module from a rear motor module to readily repair the front and rear modules. This also facilitates construction of the rear module with different kinds of engines and adapt these different rear motor modules to the standard front module. The snow blower also includes a drive train conveniently including a frangible coupling, for safety, with that coupling exteriorly extending for readily replacement of the shearable safety bolts in it and for corresponding convenient maintenance.

4 Claims, 9 Drawing Figures

4
19
10
3
11
26
12
16
18
14
13
3
4

19
12
17
16
13
17

MODULAR SNOW BLOWER ASSEMBLY

This invention relates to a snow blower of the type forming an implement attachable at the end of a vehicle and displaced by the latter and is a continuation-in-part of Ser. No. 391,517, filed June 24, 1982 and now abandoned.

The snow blowers that have been conceived and made so far are all of unitary construction to be attached only as a single unit to an operating carrier vehicle. Such unitary construction results in avoidable maintenance and logistic difficulties upon breakdown of the snow blower. It has been noted that the snow-gathering helical blades and the drive therefor, forming part of such snow blower, are the most frequent cause of breakdown and require for their repair substantial downtime for the entire snow blower.

It is a general object of the present invention to provide a snow blower of the above type, which is particularly constructed and arranged to reduce the need for maintenance and the downtime of the snow blower as a whole.

It is a more specific object of the present invention to provide a snow blower of the above type, which is of modular construction to allow readily removal of the defective module and replacement thereof, such as to minimize the downtime for the whole snow blower.

It is another object of the present invention to provide a snow blower of the above type, which is provided with a drive train having shearable pins conveniently arranged for external projection and readily access thereto.

The above and other objects and advantages of the present invention will be better understood with reference to the following detailed description of a preferred embodiment thereof which is illustrated, by way of example, in the accompanying drawings, in which.

The illustrated snow blower 10 is attached at the front end of a tractor 11, of conventional construction. The snow blower 10 includes a front snow-blowing module 12 and a rear motor module 13.

Figure 1:
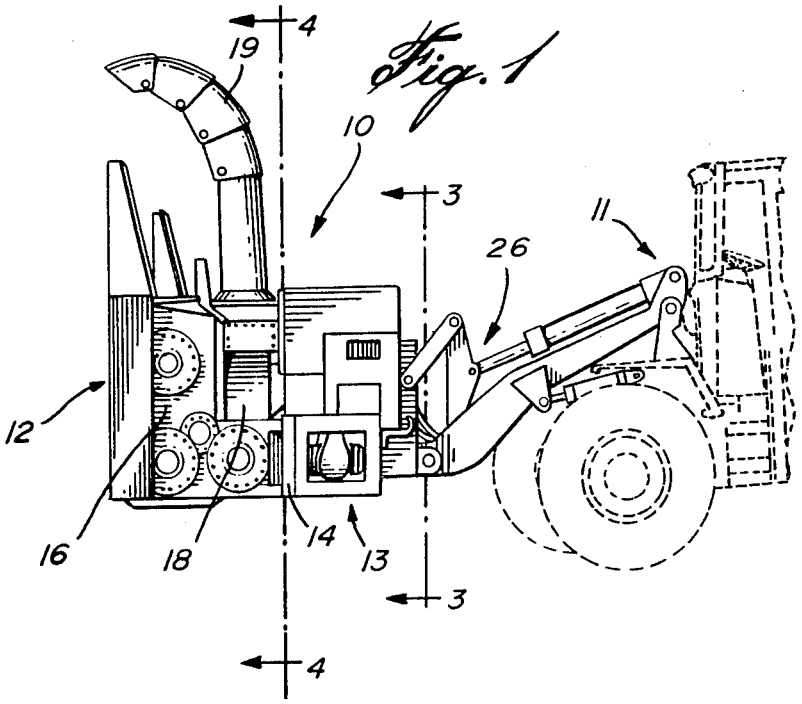
FIG. 1 is a perspective view of a modular snow blower assembly attached as an implement at the front of a tractor according to the present invention.
Figure 2:
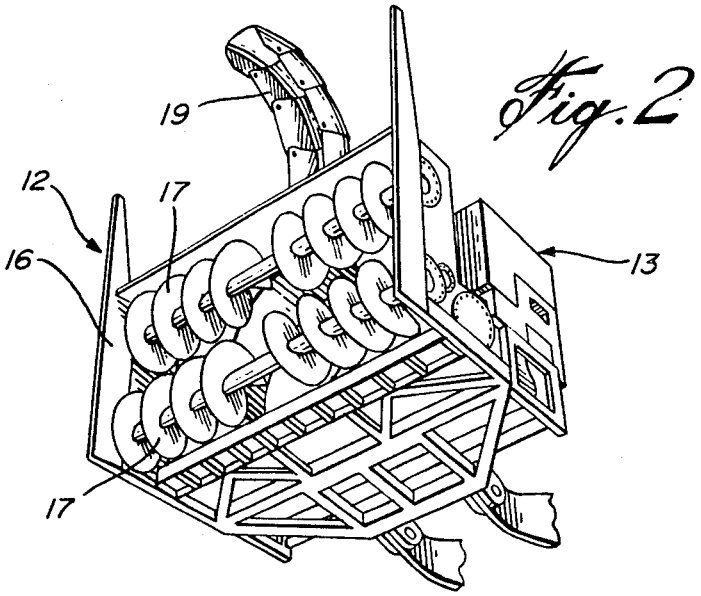
FIG. 2 is a perspective view of the modular snow blower assembly of FIG. 1.
Figure 3:
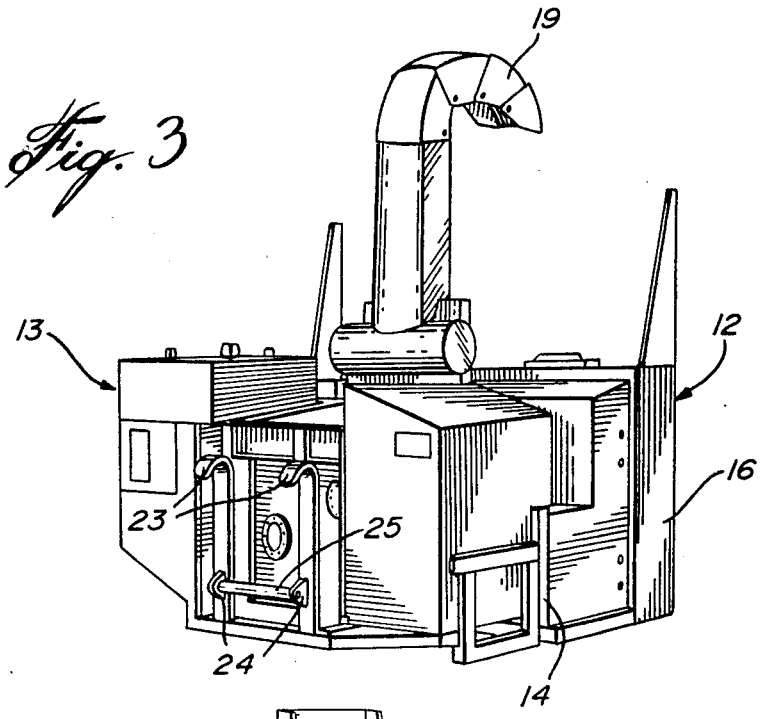
FIG. 3 is a perspective view of the modular snow blower assembly as seen from the rear thereof.
Figure 4:
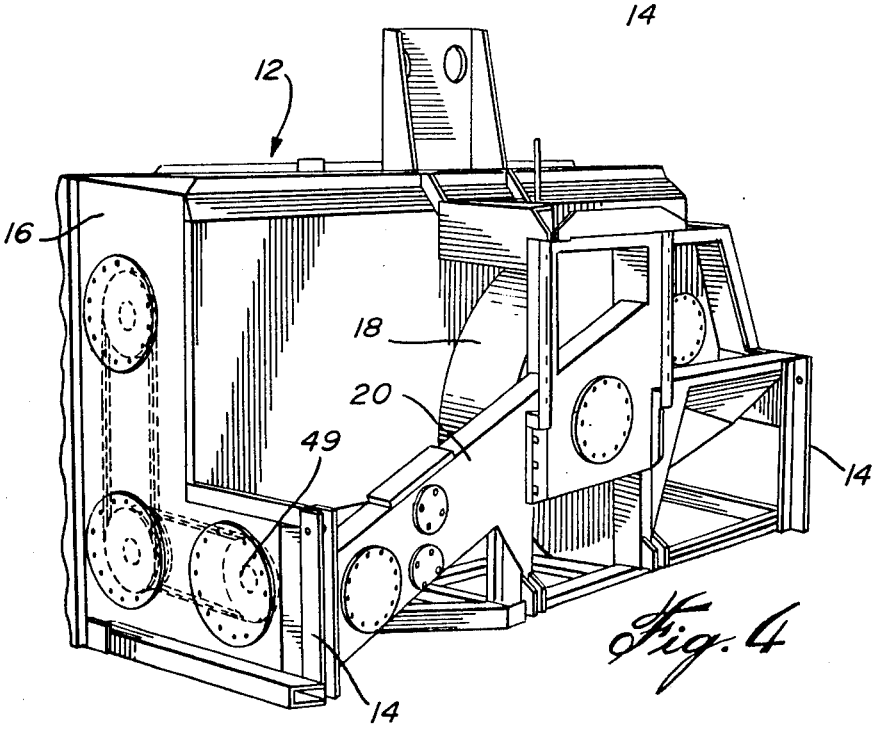
FIG. 4 is a perspective view of a front snow-blowing module forming part of the modular snow blower assembly.
Figure 5:
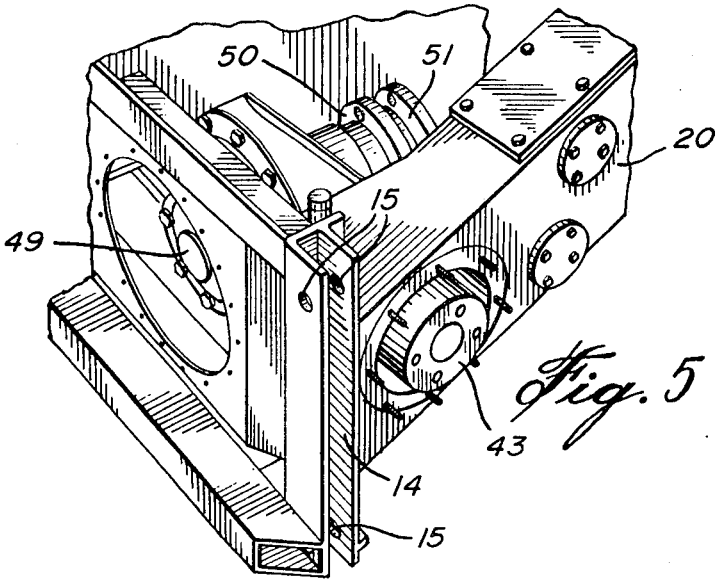
FIG. 5 is an enlarged detail view of part of FIG. 4 illustrating a corner of the frame arranged for connection of the front module to the rear motor module, also forming part of the illustrated snow blower.

The front snow-blowing module 12 includes a frame comprising a pair of laterally spaced-apart posts 14 for coupling together of the modules, as illustrated in FIG. 5. The posts 14 are of U-shape cross-section to each form a rearwardly-opened groove. Holes 15 are provided at the bottom and top of each of upright coupling posts 14 to transversely secure cupling pins in them. The front snow-blowing module 12 includes a housing 16, in which are conventionally and rotatably mounted a pair of helical blades 17. The latter extend transversely of the snow blower and are superposed to bite into the snow banks and loosen the snow. The housing 16 rearwardly projects into a cylindrical portion 18 defining a fore and aft axis and in which is rotatably mounted a blower, not shown, but of conventional construction. A blower outlet duct 19 upwardly projects from the top of the blower portion 18 in communication with it to outwardly and directionally blow the snow. A casing 20 is secured behind the casing 16 and transversely extends to house a chain and sprocket drive for the afore-mentioned blower.

The rear motor module 13 includes a frame 21 including a pair of laterally spaced-apart upright posts 22 laterally registering with the posts 14 and engagable in the slots of the latter. The posts 22 are thus removably pinned to the posts 14 to produce a readily disconnectable coupling. The modules are thus readily coupled one with the other. The rear of the rear motor module 13 is provided with a pair of hooks 23, lugs 24 and a transverse bar 25 to be readily engaged by the lifting arm mechanism 26 of the tractor 11.

Figure 6:
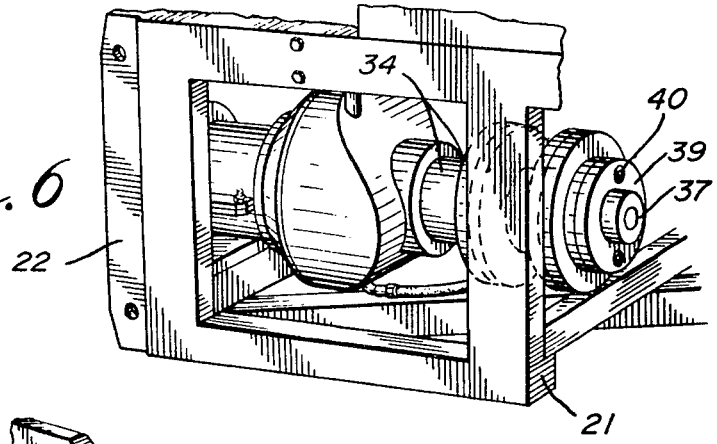
FIG. 6 is a perspective view of part of a drive train-forming part of the rear motor module and including a shearable pin connection for safety.
Figure 7:
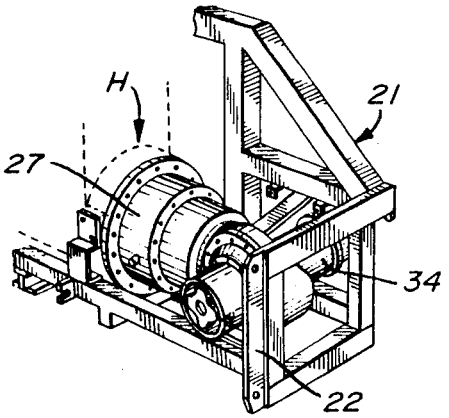
FIG. 7 is a perspective view of a portion of the rear motor module and including a portion of a drive train connecting to a motor to drive snow-gathering helical blades installed in the front snow-blowing module.
Figure 8:
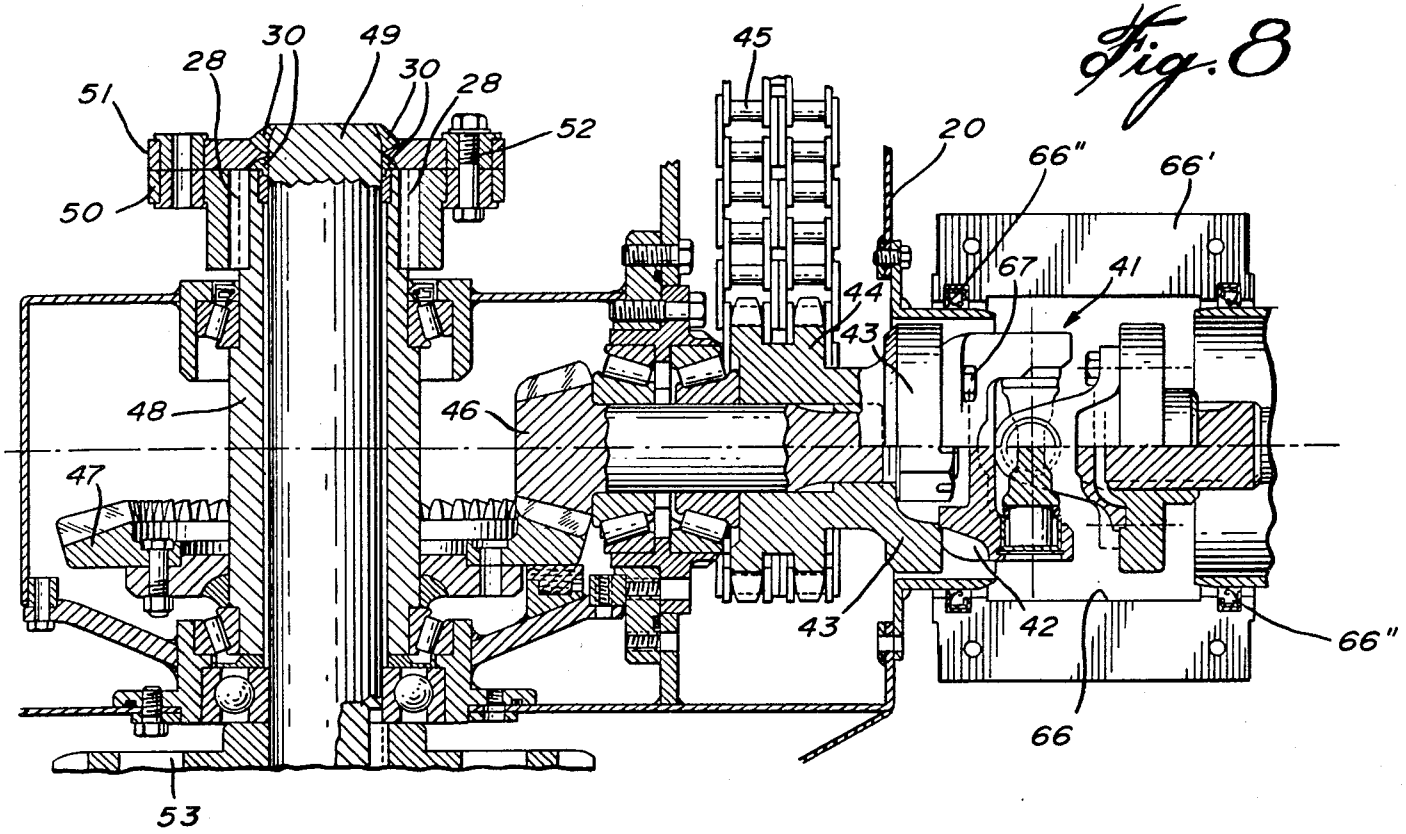
FIGS. 8 and 8A illustrate a cross-sectional view of a drive train operatively extending in the front and rear modules to drive the snow-blowing endless screws.
Figure 8A:
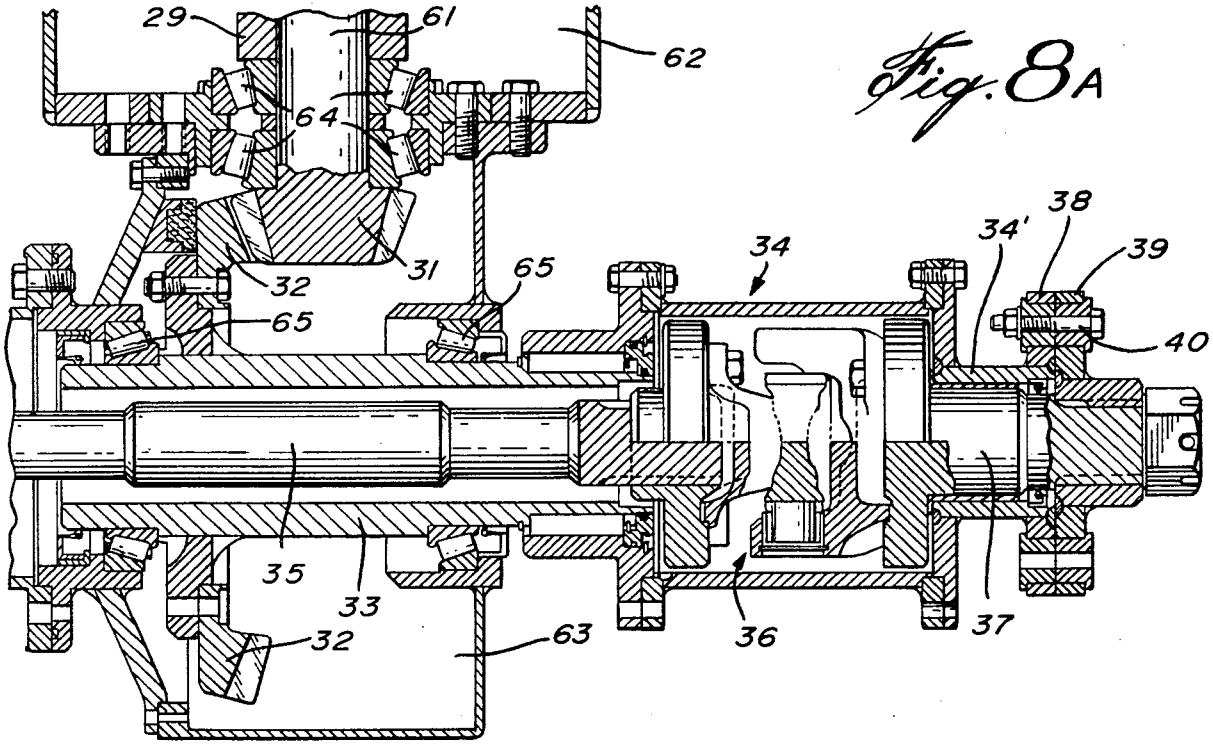

The modular snow blower assembly also includes a drive train, shown in detail in FIGS. 8 and 8A and in parts in FIGS. 5, 6, and 7.

The drive train is connected to the output shaft 29 of a motor, not shown, transversely mounted on the frame of the rear module and provided with a conventional clutch. The shaft 29 transversely extends relatively to the snow blower and is secured to the pinion shaft 61. The pinion 31 meshes with a bevel ring gear 32 fixedly secured on a tubular outer shaft 33 for bodily rotation with it around a fore and aft axis. An oil bath inside two connecting chambers 62, 63 is lubricating the pinion 31, ring gear 32, and the bearings 64 supporting the pinion shaft 61 and also the bearings 65 supporting the tubular outer shaft 33. The shaft 33 is flanged to form an enlargement defining a casing 34 which is provided with an outer tubular end 34'.

An inner shaft 35 is mounted co-axially inside the outer tubular shaft 33 and is connected to a universal joint 36 inside the casing 34. The shaft 35 is provided with an outer end 37. The inner and outer shaft ends 34' and 37 are formed with flanges 38 and 39, respectively, which are frangibly coupled together by shearable bolts 40. This arrangement produces a safety coupling between the inner shaft and outer shaft, which is easily reachable for repairs.

Thus, an advantage fo this invention is the particular arrangement of inner and outer shafts to locate the shearable bolts at an accessible place.

The inner shaft 35 is connected at its inner end to a universal joint 41. The universal joint is enclosed in a protective casing 66, of cylindrical shape, and made of two semicylindrical parts interconnected by flanges 66' depending from the respective parts. To couple the front snow-blowing module 12 to the rear snow-blowing module 13, the first operation is to secure the two frame sections together by means of two spaced-apart upright posts 22 laterally registering with the posts 14 and engageable in the slots of the latter; the second operation is to remove one half-part of the casing 66 to secure the extremity plate 42 of the universal joint 41 with the hub portion 43 of a sprocket wheel 44 by means of four bolts 67 which form the detachable connection between the two drive train portions.

The casing 66 is then closed and its seals 66" fully protect the universal joint 41.

In the front snow-blowing module 12, the sprocket wheel is carrying a chain 45 driving the blower, not shown, The chain 45 is running in the casing 20.

A pinion 46 is secured to the shaft of sprocket wheel 44. A bevel ring gear 47 is fixed on an outer tubular transverse shaft 48 in meshing engagement with the bevel gear 46. An inner transverse shaft 49 extends co-axially inside the outer tubular transverse shaft 48. A weld 30 is securing the inner transverse shaft to the flange 51 and a key 28 is securing the outer transverse shaft 48 to the flange 50, which flanges 50 and 51 are frangibly interconnected by shearable bolts 52. The opposite end of the inner transverse shaft 49 is provided with sprocket wheel 50 bodily rotatable therewith. The latter is connected by a sprocket chain, not shown, to drive the helical blades 17.

If only the helical blades 17 are jammed, the shear-pins 52 should break. Another advantage of the invention is that the latter are readily accessible in the space between the housing 16 and the casing 20 to be replaced. Jamming of either the helical blades 17 or the blower may similarly break the shearable bolts 40 instead of the bolts 52. The bolts 40 are readily accessible at the rear of the rear module where they outwardly project.

What I claim is:

1. A modular snow-blower assembly designed to be attached to the front end of a tractor or other similar vehicle and comprising a rear motor module and a front snow-blowing module, said rear motor module including a frame for supporting a motor, operating independently of said motor vehicle, said front snow-blowing module comprising a housing, helical blades rotatably mounted in said housing and a blower rotatably mounted in the rear section of said housing, said blower adapted to evacuate the snow through an outlet duct, coupling means carried by the respective modules to readily and selectively couple and uncouple the modules relative one to the other, and a drive train for transmitting the power from the motor in the motor module to the helical blades and blower of the snow-blowing module and including first and second shaft portions respectively located in the rear and front modules, and means to couple and uncouple said first and second shaft portions concurrently with relative coupling and uncoupling of said housing and frame.

2. A modular snow blower assembly as defined in claim 1, wherein said inner and outer shafts axially extend in fore and aft direction, the one end of the inner shaft and of the outer tubular shaft and the shear pin means are accessible rearwardly of the rear motor module.

3. A modular snow blower assembly as defined in claim 2, wherein said inner shaft has the other end thereof forwardly projecting from the corresponding other end of the outer tubular shaft and a sprocket wheel is secured on said other end of the inner shaft and rotatable therewith to provide rotation to snow-gathering helical blades operatively mounted in the front snow-blowing module.

4. A modular snow blower assembly comprising, in combination, a rear motor module, a front snow-blowing module, a coupling system constructed and arranged to readily and selectively couple and uncouple the modules relative one to the other, a drive train having a first portion operatively extending within the rear motor module, and a second portion extending within the front snow-blowing module, said portions having end parts provided with means to couple and uncouple said first and second end parts concurrently with selective coupling and uncoupling of the modules, said drive train further including an inner shaft and an outer tubular shaft co-axially engaged over the inner shaft and defining one end axially registering with one end of the inner shaft, each of said inner and outer shafts including a flange secured thereto and bodily rotatable therewith at said inner end thereof, and shearable bolts fastening said flanges one to the other, and wherein each of said modules includes a frame, the frame of the front snow-blowing module including a pair of laterally spaced-apart rear upright members, the frame of the rear motor module including a pair of laterally spaced-apart front upright members laterally registering with the rear upright members, respectively of the front module, and the coupling system including said front and rear upright members and pins releasably connecting the rear upright members to the front upright members, respectively.

* * * * *